United States Patent [19]

Howard

[11] Patent Number: 5,037,341

[45] Date of Patent: Aug. 6, 1991

[54] INFLATABLE LIFE PRESERVER

[76] Inventor: Thomas L. Howard, 1972 Scudder Dr., Akron, Ohio 44320

[21] Appl. No.: 535,422

[22] Filed: Jun. 8, 1990

[51] Int. Cl.[5] ..... B63C 9/15

[52] U.S. Cl. ..... 441/89; 441/106; 441/108; 441/113

[58] Field of Search ..... 441/40–42, 441/88, 89, 90, 92–94, 106–119

[56] References Cited

U.S. PATENT DOCUMENTS

| | | | |
|---|---|---|---|
| 3,357,032 | 12/1967 | Worcester | 441/118 |
| 4,379,705 | 4/1983 | Saotome | 441/108 |
| 4,626,221 | 12/1986 | Rocco | 441/113 X |

*Primary Examiner*—Sherman Basinger

*Attorney, Agent, or Firm*—Joseph Januszkiewicz

[57] ABSTRACT

An inflatable life preserver that is made from a gas impervious material in a generally rectangular shape with a closed chamber. A valve is connected thereto for inflating the chamber. The life preserver has fasteners to retain the life preserver into an annular shape that encompasses the wearer around the chest as a chest support. Such fasteners include a strap that extends over the shoulder and a safety snaps for the front of the chest with provisions for quickly releasing the fasteners. Positive flotations are provided in the chamber and provide buoyancy to the weaver. Such positive flotations include closed cell pads and an open cell pad wherein the latter in its compressed condition is a leak detector indicator when the life preserver is in a deflated condition.

16 Claims, 3 Drawing Sheets

INFLATABLE LIFE PRESERVER

BACKGROUND OF THE INVENTION

This invention relates to a life preserver and more particularly to a new and improved life preserver of a hybrid type that has an inflatable rectangular body or envelope with a closed chamber with buoyancy elements or pads therein.

Most life preservers have either an inflatable tube or buoyancy elements attached thereto to maintain the wearer's head out of the water. Many of these life preservers are cumbersome and bulky, taking up considerable room for maneuvering when being worn. The present invention is directed to a life preserver that is compact in size, can be worn while in a boat without interfering with one's mobility yet can be easily activated for positive inflation to hold the wearer in a proper attitude in the water, assuring full support. While being worn in the deflated condition, the life preserver of the present ivention provides positive visual indication that the life preserver is in its full operative condition and that there is no leakage in the gas impervious material of the life preserver. This is achieved by having a pad of open cell foam material, which can be an elastomeric material, within the chamber and when deflated, the open cell pad is compressed and retains its compressed condition since all the air within the chamber has been extracted. Where a tear in the material occurs, the air leakage into the closed chamber will fill the open cell foam, which will then expand to its full condition. Further, the inflation elements in this life preserver provide sufficient emergency buoyancy to the wearer without inflation. The shape of the life preserver in a stored condition is flat and easily packed. Such life preserver can be quickly positioned on a wearer and wrapped around the wearer's chest and secured for use thereon.

SUMMARY OF THE INVENTION

A life preserver worn around the torso or chest of a wearer, wherein the preserver is a generally rectangular shaped gas impervious support with an inflatable chamber. Valve means are mounted on the support and is operable to inflate the chamber which can be secured into an annular form by fastening means. Such fastening means includes manually operable valve to inflate the chamber and capsule or cartridge operable means to inflate the chamber. Flotation means are located and secured within the chamber to the support and to provide buoyancy to the wearer. Such flotation means includes open and closed cell foam pads wherein such can also act as leak detection indication means.

DESCRIPTION OF THE DRAWINGS

The invention will be explained in conjunction with an illustrative embodiment shown in the accompanying drawings, in which.

DESCRIPTION OF THE PREFERRED EMBODIMENT

Figure 1:
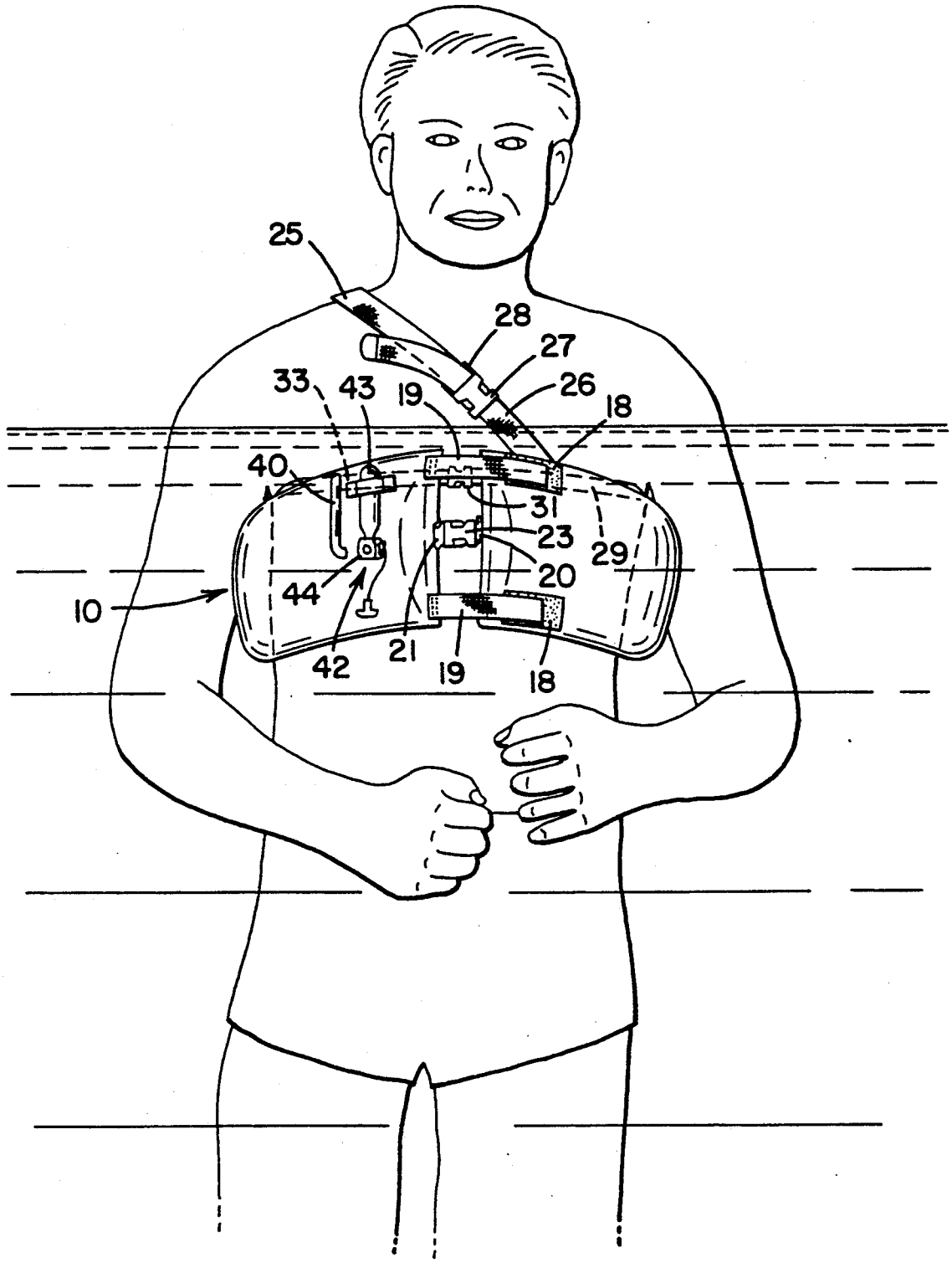
FIG. 1 is a front elevational view of a preferred form of the invention, a life preserver as it appears when inflated and fastened upon a user.
Figure 2:
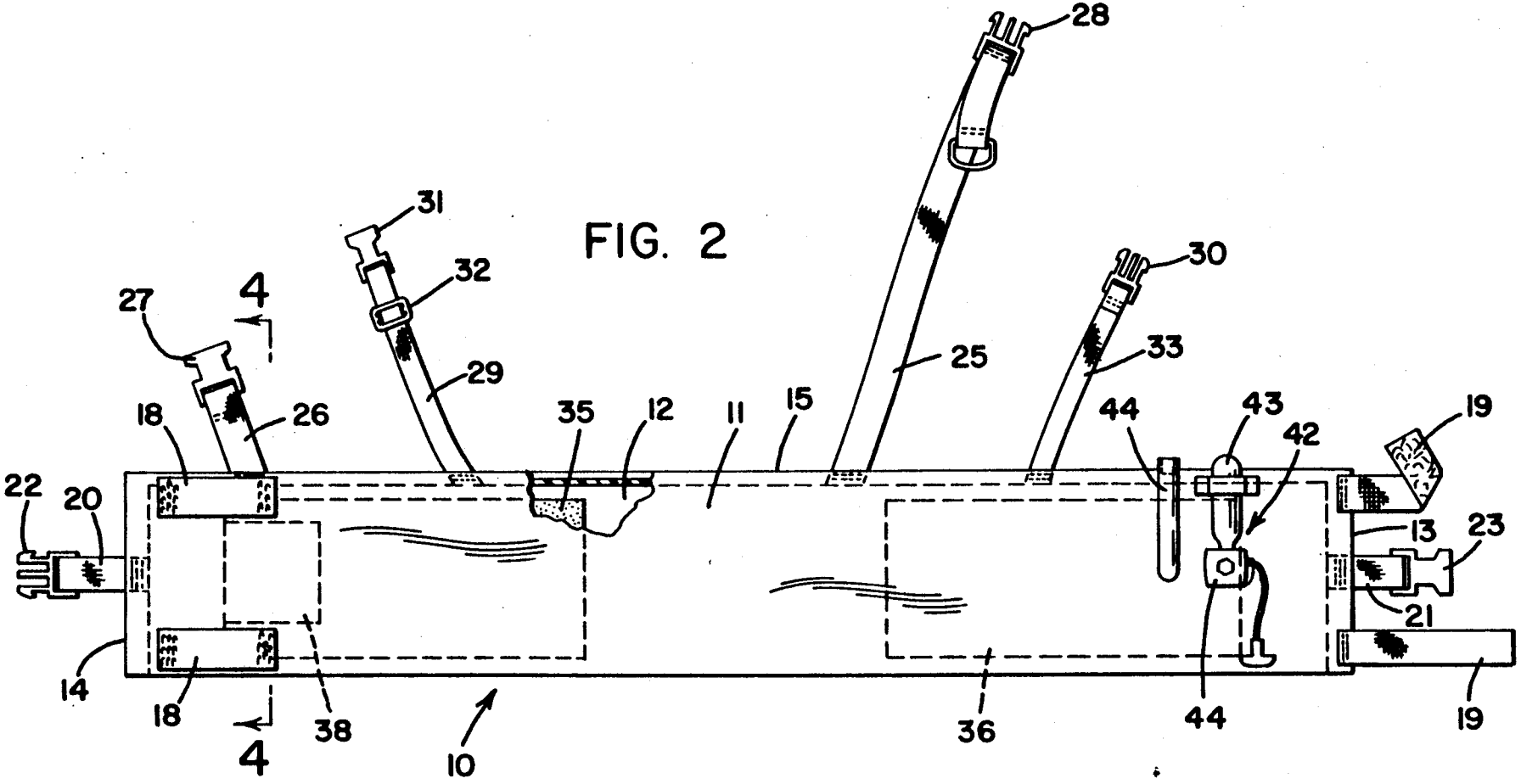
FIG. 2 shows the life preserver of FIG. 1 when it is unfolded and flattened with the outside surface displayed.
Figure 3:
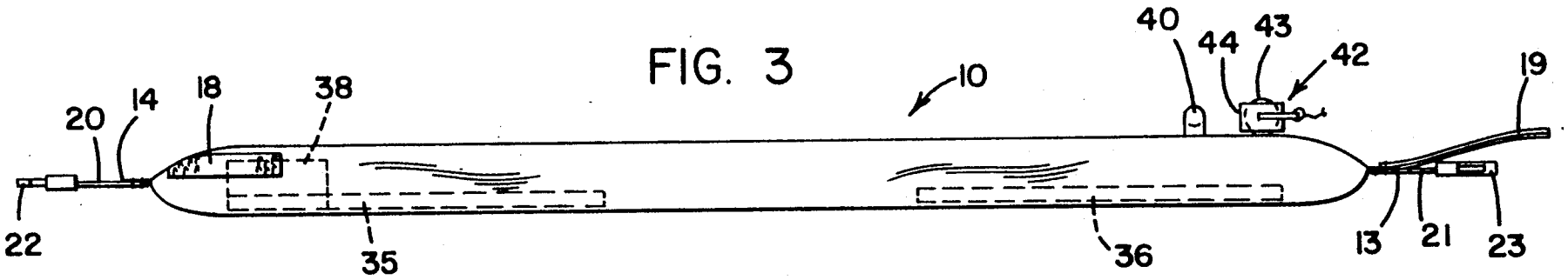
FIG. 3 is a bottom view of the life preserver as unfolded in FIG. 3.
Figure 4:
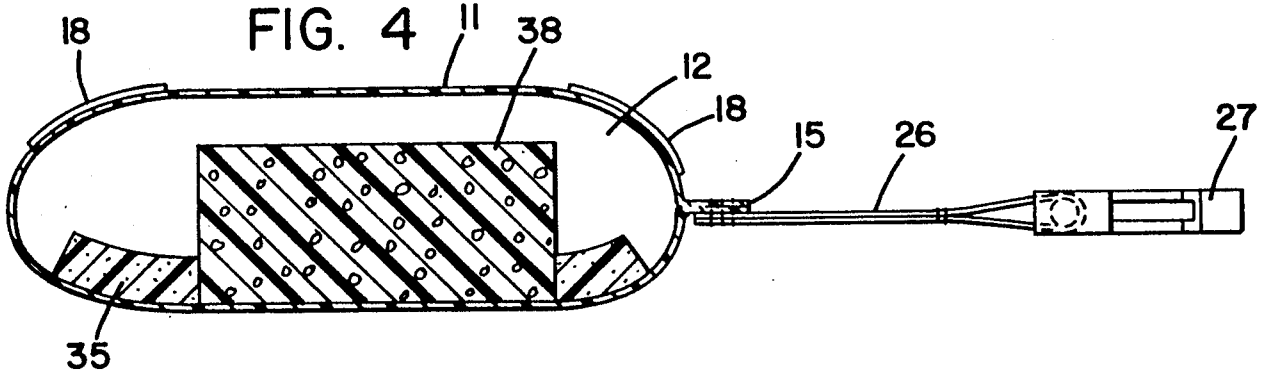
FIG. 4 is a cross sectional view taken in line 4—4 of FIG. 2, with the life preserver in an inflated condition.

Referring to the drawings wherein like reference numerals designate like or corresponding parts throughout the several views, there is shown in FIG. 1 and 2 a life preserver 10 which is a hybrid type of inflatable torso or chest support 11 comprising a generally rectangular flat flexible gas impervious envelope of polyurethane material with a closed chamber 12 (FIG. 4). Such rectangular shaped chest support 11 may be constructed from a single longitudinally extending piece of material folded over to form the envelope or a pair of rectangular panels heat sealed along the entire periphery to form such closed chamber 12 of chest support 11. The preferred form is shown in FIGS. 2 and 4 as consisting of a single panel which is heat sealed along its end portion as at 13 and 14 and along its one side 15.

The one end portion 14 of rectangular shaped chest support 11 has a pair of laterally spaced flat strips 18—18 suitably adhered thereto, while the other end portion 13 of rectangular shaped chest support 11 has the respective ends only of a pair of laterally spaced flat strips 19—19 secured thereto. Such strips 18—18 and 19—19 are fastener means with face-to-face bristle hook and loop type material respectively, which when placed into engagement provides a ready means to adjustably secure the chest support into an annular bend around the torso of a wearer, just below the shoulders. Such fastener means 18—18 and 19—19 is well known as VELCRO® fastener material. The fastener means are used to secure the life preserver 10 onto the wearer's torso to provide a snug fit so that the support 11 does not interfere with the movement of the wearer. Closely adjacent to the respective ends 14 and 13 are straps 20 and 21, whose end portions are provided with fastening means 22–23 respectively, such as quick-release fastening means.

The life preserver 10 has the ends of a pair of spaced straps 25 and 26 suitably attached to one side edge 15 of the chest support 11. Straps 25 and 26 have quick release fastening means 27 and 28 suitably secured thereto. Straps 25 have an adjustable buckle thereon to adjust the length thereof. Such straps 25 and 26 extend over the shoulder of the wearer as shown in FIG. 1 with the adjustable buckle permitting the adjustment to the wearer's size.

Also mounted on the one side edge 15 of life preserver 10 are a pair of spaced straps 29 and 33 having quick release fastening means 30 and 31 secured to the respective end portions thereof. Strip 29 has an adjustable buckle 32 mounted thereon to facilitate adjusting the length thereof. Straps 29 and 33 are used to buckle in the front of the wearer as a safety belt to assure the wearer of the proper mounting of the life preserver around the chest of the wearer.

Located within the chamber 12 of the life preserver are a pair of spaced closed cell pads or blocks 35 and 36 of foam or elastomeric foam suitably adhered to one inside wall of the envelope of polyurethane material. Such blocks of foam 35 and 36 provide a built-in buoyancy of 4 to 14 pounds, preferably 7 to 10 pounds. Such buoyancy pads or blocks 35 and 36 provide sufficient flotation to the wearer to assure a minimum flotation which together with the inflated envelope can then provide the wearer enough flotation to keep his head completely out of the water assuring the wearer of proper attitude, position and unrestricted breathing without fear of banking water under adverse conditions. The degree or extent of buoyancy can be adjusted on each life preserver by the extent of inflation of the chamber 12.

Figure 5:
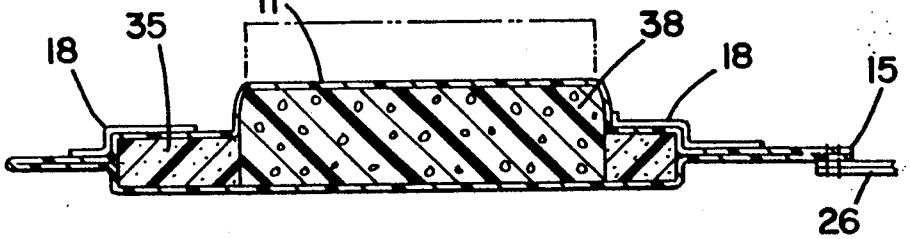
FIG. 5 is a cross sectional view of the life preserver similar to FIG. 4 but with the preserver in a deflated condition.

An open cell foam block 38 is suitably adhered or secured to the polyurethane material to provide a visual leak detection means. Such block 38 can be compressed to one-third its normal size whenever the life preserver 10 is relieved of all its trapped air. In this instance, the foam block 38 is compressed and remains in its compressed condition since the open cell structure is relieved of all air or gases. Should the gas impervious envelope develop a leak, atmosphere air will be taken on or absorbed by the open cell foam and expand to its normal size, which is two-thirds greater than its compressed condition as illustrated by FIGS. 4 and 5. Under these conditions, the wearer is made aware of the defective life preserver and can take immediate steps to correct and replace the life preserver. In the event that such leak occurs while the life preserver is in use, the buoyancy blocks 35 and 36 provide sufficient buoyancy as an emergency flotation device.

There is provided two means for inflating the chamber 12 of the life preserver 10. A mouth valved tube 40 located on the gas impervious envelope of the chest support 11 provides means by which the wearer can inflate the chamber by mouth. Such valved tube 40 is of a size and shape to facilitate its use as the prime means for inflating the life preserver or to help keep up the pressure in the chamber 12 should there be a slow leak.

The second means or inflation assembly 42 for inflating the chamber 12 contains a gas cylinder or capsule 43, mounted on the same side of the chest support 11 as the valved tube 40. The valved tube 40 and the capsule 43 are located closely adjacent to each other to assure easy access to the wearer and full control at one location. The gas capsule or cylinder 43 may be a carbon dioxide cylinder and is connected to a molded activator housing 44 which is connected to a lanyard 45 for actuating the carbon dioxide cylinder to inflate and pressurize chamber 12. Such inflation assembly 42 is illustrated more fully by U.S. Pat. Nos. 3,754,731; 3,809,288 and 4,887,987. Both inflation means are available from the Halkey-Roberts Corporation of Spring Valley Avenue, Paramus, N.J. 07652.

In the use of such life preserver 10, the wearer will wrap the chest support 11 abut his torso or chest using the VELCRO® fastening means 18-19, the safety belt of fastening means 30 and 31 to secure the chest support 11 in place. The straps 25 and 26 are then secured, with the strap 25 passing over the wearer's shoulder as illustrated in FIG. 1. Such strap 25 is then adjusted to firmly secure the chest support in its position on the wearer in cooperation with face-to-face bristle hook and loop type strips 18—18 and 19—19. The chamber 12 is then ready for inflation by either the valved tube 40 or the inflation assembly 42 as described above.

In the deflated condition of chamber 12 of the support 11, the VELCRO® fastening means are engaged as the support is snugly wrapped around the wearer's chest to firmly secure the support thereon so the support 11 does not interfere with the arm movement or general movement of the wearer. The shoulder straps 25 and 26 are used to assure the wearer that the support 11 remains in its adjuted position on the wearer. The straps 29 and 33 are adjusted on the wearer to provide slack or clearance space for the expansion that occurs when chamber 12 is inflated.

Upon inflation of chamber 12 by the wearer, either by mouth valved tube 40 or via gas cylinder 43, the rectangular shaped chest support 11 will enlarge its outer circumference materially and break the bonds between the VELCRO® fastener strips 18—18 and strips 19—19 which in effect renders them inoperative and thence the straps 29 and 33 in cooperation with the support 11 take over to snugly encompass the wearer. Such action places the respective closed cell pads 35 and 36 directly under the arms of a wearer to provide a balanced flotation to the wearer, i.e. keeps the person upright. On such inflation of the chamber 12, the straps 29 and 33 are firmly abutting the chest of the wearer as the inflated support 11 comes into firm contact with the wearer's back and sides to prevent projecting the wearer's head forwardly into the water.

While a certain representative embodiment and details have been shown and described for the purpose of illustrating the invention, it will be apparent to those skilled in the art that various changes and modifications other than those referred to may be made therein without departing from the spirit and scope of the invention.

What is claimed is:

1. An inflatable life preserver to be worn around the chest of a wearer comprising a substantially rectangular body of flexible gas impervious materials, said rectangular body having opposite side panels with a common periphery, said periphery having a pair of spaced side edges and a pair of spaced end edges, said side panels being sealed along said periphery to define a closed inflatable chamber, a valve means mounted on said rectangular body for communication with said chamber for inflating said chamber, fastener means mounted adjacent said end edges for securing said flexible rectangular body into an annular shape for encompassing the chest of a wearer, strap means secured to said rectangular body for securing and maintaining said rectangular body into said annular shape around the wearer's chest, closed cell foam pad means within said chamber and secured to said rectangular body of gas impervious material to provide buoyancy to a wearer, and a leak detection means located within said chamber operative to provide a visual means to indicate a leak of said gas impervious material when said body of gas impervious material is in a deflated condition.

2. An inflatable life preserver as set forth in claim 1 wherein said leak detection means comprises a pad of open cell foam.

3. An inflatable life preserver as set forth in claim 2 wherein said buoyancy of said closed cell foam pad means is in the range of 4 to 14 pounds

4. An inflatable life preserver as set forth in claim 2 wherein said buoyancy of said closed cell foam pad means is in the range of 7 to 10 pounds.

5. An inflatable life preserver as set forth in claim 2 wherein said valve means includes a capsule containing compressed gas that is operative upon actuation to inflate said chamber.

6. An inflatable life preserver as set forth in claim 5 wherein said closed cell foam pad means comprises a pair of spaced closed cell foam pads of material that place the same amount of closed cell foam pads of material to either side of the wearer relative to a vertical plane passing through the shoulders of a wearer.

7. An inflatable life preserver as set forth in claim 5 wherein said buoyancy of said foam pad means is in the range of 4 to 14 pounds.

8. An inflatable life preserver as set forth in claim 5 wherein said buoyancy of said foam pad means is in the range of 7 to 10 pounds.

9. An inflatable life preserver as set forth in claim 5 wherein said valve means includes a manual mouth inflatable valve for inflating said chamber, and said mouth valve and said capsule are located closely adjacent to each other to provide ease of operation and control.

10. An inflatable life preserver to be worn around the chest of a wearer comprising an inflatable generally rectangular shaped support, said rectangular support having a closed chamber for inflation, fastening means secured to said inflatable support to retain said support in an annular form for maintaining said support around the chest of a wearer, valve means connected to said inflatable support operable to inflate said chamber, flotation means located within said chamber and fastened to said inflatable support to provide buoyancy to a wearer, and said floation means includes pad means of open cell and closed cell elastomeric foam wherein said open cell foam pad means provides for a leak detection means of said life preserver when in a deflated condition.

11. An inflatable life preserver as set forth in claim 10 wherein said valve means includes a first and second valve means, said first valve means is a valve for manually inflating said chamber, and said second valve means includes a capsule containing compressed gas that is operative upon actuation to inflate said chamber, and an actuator means connected to said capsule for actuating said capsule.

12. An inflatable life preserver as set forth in claim 11 wherein said first and second valve means are closely adjacent to each other.

13. An inflatable life preserver as set forth in claim 11 wherein said fastening means includes at least a pair of strap means, one of said strap means is an adjustable shoulder strap, and another one of said strap means is an ajustable safety strap that firmly secures said inflatable support around a wearer's chest.

14. An inflatable life preserver to be worn around the chest of a wearer comprising an inflatable generally rectangular shaped support, said inflatable rectangular support having a closed chamber for inflation, first fastening means secured to said inflatable support, said first fastening means operative in a first condition to fasten said inflatable support into an annular deflated shape firmly around the chest of a wearer, valve means connected to said inflatable support and operable to inflate and deflate said chamber, flotation means located within said chamber and fastened to said inflatable support to provide buoyancy to a wearer, second fastener means secured to said support and operative in the fastened condition to provide slack in said second fastener means when said closed chamber of said support is deflated, said first fastening means retaining said inflatable support in an annular shape when said inflatable support is deflated, said valve means operative to inflate said chamber to unfasten said first fastening means and place said second fastener means into a taut condition and a position to retain said inflated support around the back and sides of a wearer with said second fastener means being taut to snugly retain said support in its inflated condition against the chest of a wearer to assure an upright position to a wearer.

15. An inflatable life preserver to be worn around the chest of a wearer comprising an inflatable generally rectangular shaped support, said inflatable support having a closed chamber for inflation to provide buoyancy to a wearer of said support, a first fastening means secured to said support, said first fastening means operative in a first condition to fasten said support into an annular shape to firmly retain said support around the chest of a wearer, valve means connected to said inflatable support to selectively inflate and deflate said chamber, said first fastening means retaining said inflatable support in an annular shape when said support is in a deflated condition, second fastener means secured to said support, said second fastener means operative in its fastened condition to provide slack in its retention of said deflated support around the chest of a wearer, and said valve means operative to inflate said chamber to unfasten said first fastening means and place said second fastener means in cooperation with the distention of said support upon inflation of said chamber into a position to firmly retain said inflated support snugly around the chest, side and back of a wearer and for retaining said inflated support in an annular shape.

16. An inflatable life preserver as set forth in claim 15 wherein said chamber houses a pair of closed cell foam pads for buoyancy and an open cell foam pad to visually indicate a leak when said chamber is in a deflated condition.

* * * * *